United States Patent [19]

Yamazaki

[11] Patent Number: 4,656,110

[45] Date of Patent: Apr. 7, 1987

[54] ELECTROPHOTOGRAPHIC PHOTOSENSITIVE MEMBER HAVING A PHOTOCONDUCTIVE LAYER OF AN AMORPHOUS MATERIAL

[75] Inventor: Mutsuki Yamazaki, Yokohama, Japan

[73] Assignee: Kabushiki Kaisha Toshiba, Kawasaki, Japan

[21] Appl. No.: 779,065

[22] Filed: Sep. 23, 1985

[30] Foreign Application Priority Data

Oct. 24, 1984 [JP] Japan ..... 59-221962

[51] Int. Cl.[4] ..... G03G 5/082

[52] U.S. Cl. ..... 430/57; 430/85; 430/94

[58] Field of Search ..... 430/58, 57, 66, 67, 430/85, 94

[56] References Cited

U.S. PATENT DOCUMENTS 4,064,521 12/1977 Carlson ..... 357/2
4,460,669 7/1984 Ogawa et al. ..... 430/57
4,510,224 4/1985 Yamazaki et al. ..... 430/65
4,539,283 9/1985 Shirai et al. ..... 430/95
4,544,617 10/1985 Mort et al. ..... 430/58

OTHER PUBLICATIONS

N. F. Mott and E. A. Davis "Electronic Processes in Non-Crystalline Materials"-1979.

*Primary Examiner*—John L. Goodrow
*Attorney, Agent, or Firm*—Schwartz, Jeffery, Schwaab, Mack, Blumenthal & Evans

[57] ABSTRACT

An electrophotographic photosensitive member, which is used for electrophotography, has a high dark resistivity and a high durability and achieves high charge acceptability and retentivity, the electrophotographic photosensitive member comprising a substrate, a photoconductive layer, a barrier layer provided between the substrate and the photoconductive layer for substantially inhibiting injection of carriers from the substrate to the photoconductive layer, and a covering layer provided on the photoconductive layer, wherein the layers are formed of amorphous hydrogenated silicon carbide doped with impurities.

12 Claims, 3 Drawing Figures

ELECTROPHOTOGRAPHIC PHOTOSENSITIVE MEMBER HAVING A PHOTOCONDUCTIVE LAYER OF AN AMORPHOUS MATERIAL

BACKGROUND OF THE INVENTION

This invention relates to an electrophotographic photosensitive member used for forming an image by utilizing electromagnetic waves such as ultraviolet rays, visible ray, infrared rays, X-rays, and the like. More specifically, the present invention relates to a photoreceptor used for electrophotography and having a photoconductive layer which comprises an amorphous material with, silicon as a constituent atom.

As a constituent for a photoreceptor, a solid-state image pickup device and so on, a photoconductive layer is required to have various characteristics such as a high and panchromatic sensitivity, a high S/N ratio and so forth, and to be harmless to humans. To cite one example, electrostatic charges are applied onto a photoconductive layer by corona discharge in electrophotography. Next, pairs of electrons and holes, i.e., photocarriers are generated so that the charges on the photoconductive layer are neutralized when the photoconductive layer is exposed to light. For example, positive charges on the photoconductive layer are neutralized by electrons generated in the photoconductive layer according to light exposure. Thus, an electrostatic latent image of a positive type is formed on the photoconductive layer. This latent image is visualized by depositing colored particles called toner on the photoconductive layer. The toner is oppositely charged to the charges on the photoconductive layer so as to be attracted by coulomb forces. Generally, a measure for heightening a potential of a toner depositing unit is introduced so that an electric field in reverse direction to that due to the latent image is established between the photoconductive layer and the toner depositing unit to avoid fog resulting from the inadequate triboelectric charges of toner. This measure is called developing bias. In this imaging method of electrophotography, the requirements for the photoreceptor are as follows:

(1) Charges produced by corona discharge may be retained until light exposure is performed; and (2) photocarriers generated by light exposure may reach instantly to the surface of the photoreceptor so as to neutralize the charges on the photoreceptor without recombination. To meet these requirements, non-crystalline chalcogenide has been conventionally used for photoconductive materials to constitute a photoreceptor. This material has an excellent photoconductivity; however, the limit of light absorption lies in the ultraviolet wavelength region. As a result, its sensitivity to visible rays is not sufficient to form clear images. Moreover, the hardness of the material is too low to provide a long life for the photoreceptor.

From such a standpoint, amorphous silicon (hereinafter abbreviated as "a-Si") has attracted attention for use as photoconductive material. This a-Si represents a high and panchromatic sensitivity and a high hardness and is harmless to humans. On the other hand, its dark resistivity lies in the range from about $10^8$ ohm-cm to $10^{10}$ ohm-cm. (See: "Electronic properties of substitutionally doped amorphous Si and Ge", in PHILOSOPHICAL MAGAZINE 1976, Vol. 33, No. 6, pp. 935–949, by W. E. Spear et al). Therefore, it may not retain electrostatic charges thereon for a long time. In view of the above-mentioned problems, attempts have been made to use a multi-layered photoreceptor comprising a substrate, a barrier layer and an a-Si photoconductive layer in electrophotography. For the barrier layer of this multi-layered photoreceptor, an insulator layer such as silicon nitride and silicon oxide or an a-Si semiconductor layer of p-type and n-type may be introduced. The conductive type of the semiconductor layer depends on the charging polarity of the photoreceptor. Thus, a high charge acceptability and retentivity may be achieved according to this multi-layered structure. When the insulator layer is used for the barrier layer, however, a residual potential will be increased in proportion to the thickness thereof, because the insulator layer operates to block not only carriers injected from the substrate but also photocarriers generated in the photoconductive layer. On the other hand, breakdown due to the developing bias mentioned above may occur when the thickness of the insulator is established too thin in order to prevent it from blocking the generated photocarriers. In the case of the semiconductor layer, impurities may be contained to govern the conductive type thereof. Responding to the contents of the doped impurity, however, strain in the layer is increased. As a result, separation of layers may occur due to the difference in the strain in the respective layers.

Furthermore, all problems will not be completely solved by providing the barrier layer. For example, the photoconductive layer must have a high resistivity (i.e., a high dark resistivity) to retain charges thereon for a long time. To obtain a high charge acceptability, a covering layer needs to provide on the surface of the photoconductive layer. In many cases, this covering layer is made of an insulator having a high resistivity. The mobility of electrons in such a layer is very small. Therefore, the use of the covering insulator layer results in a low photosensitivity and a high residual potential.

Even with the a-Si photoreceptor having excellent photoconductive characteristics in the various points as described above, there still remains room to improve the characteristics or the structure of the a-Si photoreceptor.

SUMMARY OF THE INVENTION

Accordingly, it is an object of the present invention to provide an improved electrophotographic photosensitive member which may be used for electrophotography.

It is a further object of the present invention to provide an electrophotographic photosensitive member which has a high sensitivity, a high dark resistivity and a high durability.

It is a still further object of the present invention to provide an electrophotographic photosensitive member which may achieve a high charge acceptability and retentivity.

These and other objects are achieved by providing a novel electrophotographic photosensitive member including a substrate, a photoconductive layer and a barrier layer provided between the substrate and the photoconductive layer for substantially inhibiting injection of carriers from the substrate to the photoconductive layer, wherein the photoconductive layer and the barrier layer are formed of an amorphous material including silicon and carbon as constituents.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, in which.

DETAILED DESCRIPTION OF THE PREFERRED EMBODIMENTS

Figure 1:
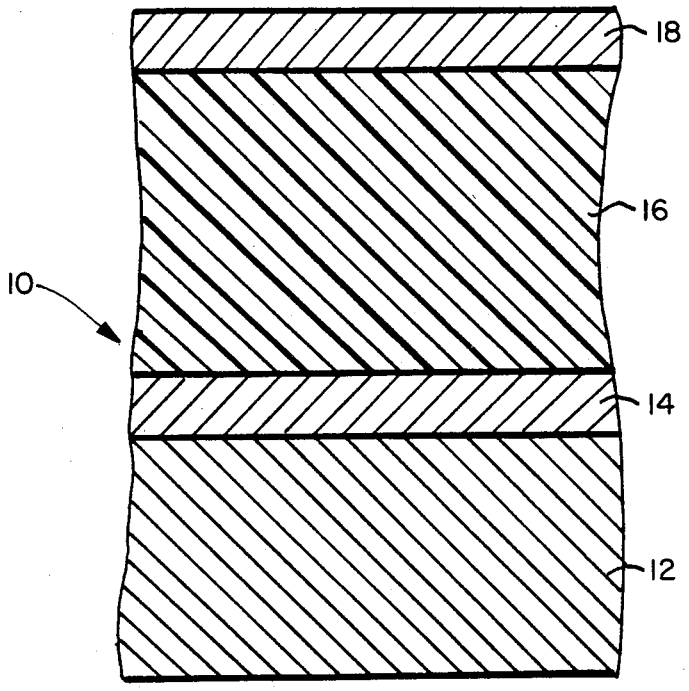
FIG. 1 is a schematic cross-sectional diagram showing a preferred embodiment of the electrophotographic photosensitive member according to the present invention.

FIG. 1 shows a structure of an electrophotographic photosensitive member for forming positively charged images thereon by utilizing electrophotography (hereinafter described as "photoreceptor") according to the present invention.

Figure 2:
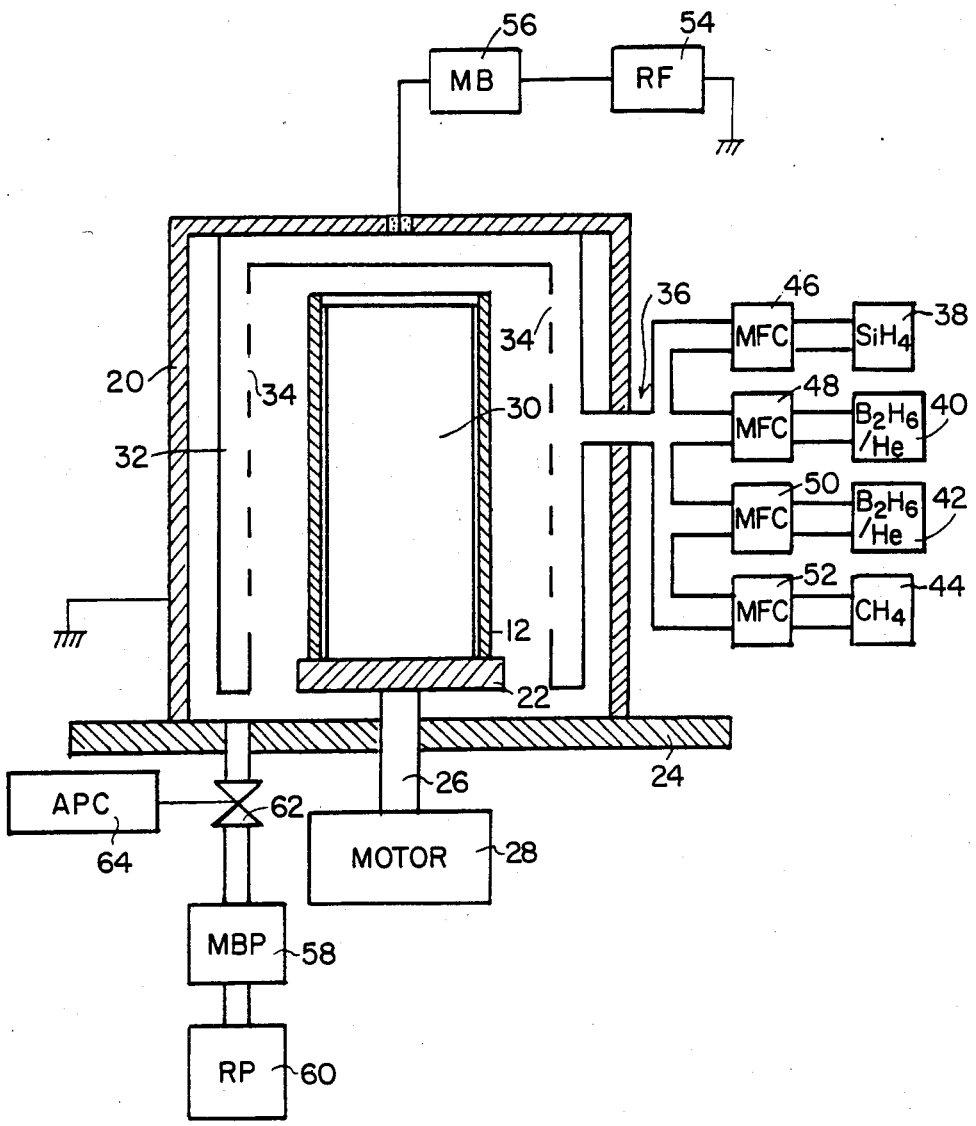
FIG. 2 is a schematic explanatory diagram of the apparatus for preparing the electrophotographic photosensitive member according to the present invention.

Referring now to FIG. 2, photoreceptor 10 is composed of a substrate 12, a barrier layer 14, a photoconductive layer 16 and a covering layer 18 in tandem.

Substrate 12 may be electroconductive or electrically insulating. For an electroconductive substrate, there may be used stainless steel, Al, Cr and the like. For an electrically insulating substrate, there may be used glass, ceramics, resins and the like. In this case, at least one side of the substrate must have an electrically conductive surface for electrophotographic imaging process. Substrate 12 may be ordinarily formed in many desired shapes, but is preferably formed as a drum for intended use in xerographic copying machines.

These layers 14, 16 and 18 are formed of amorphous hydrogenated silicon carbide doped with boron (hereinafter abbreviated as "a-SiC:H,B"), and are prepared by glow discharge, sputtering, ion plating, ion implementation, and the like. Preferably, glow discharge is utilized for preparing these layers so that it may be easily performed to incorporate impurities such as boron in order to govern its conductive types and control the contents of constituent elements such as carbon, silicon, and hydrogen. In order to incorporate hydrogen atoms in the layers, silanes, for example, $SiH_4$, $Si_2H_6$ and the like are used as raw materials. Also, at the same time, hydrocarbons, for example, $CH_4$, $C_2H_6$ and the like are introduced in order to incorporate carbon atoms in the layers. To render these layers to be n-type, p-type or intrinsic semiconductor, an impurity to govern conductivity type is also introduced during the fabrication of these layers, while controlling their impurity density. Depending upon the content and description of impurities, each amorphous hydrogenated silicon carbide assumes n-type, p-type or intrinsic. Generally, amorphous hydrogenated silicon carbide is slightly inclined to assume n-type semiconductor. By lightly doping with boron, however, it becomes intrinsic so that high resistivity is obtained. In the present invention, the impurity is selected from those atoms in Group III-A of the Periodic Table such as boron, aluminum and gallium or in Group V-A of the Periodic Table such as phosphorus, nitrogen and arsenic in accordance with the intended purpose. Namely, in the case of a photoreceptor of a positively charged type, p-type semiconductor may be used for these layers; also n-type semiconductor may be used for these layers in the case of a photoreceptor of a negatively charged type.

Barrier layer 14 is made of a-SiC:H,B and includes boron atoms as an impurity in the range from about $10^{-3}$ to 2 atomic %, or more preferably, from about $5\times10^{-3}$ to 1 atomic %. The content of carbon is in the range from about 1 to 15 atomic %, more preferably, about 8 to 12 atomic %. This particular doping quantity permits barrier layer 14 to have a desired optical band gap of about 1.75–1.85 eV and to be formed as a strainless layer. The deposition of barrier layer 14 with silanes by glow discharge results in an incorporation of hydrogen in the range from about 10 to 20 atomic %. According to the present invention, the content of hydrogen is a very important factor affecting characteristics of the layer; these requirements are satisfied when it lies in the above range. The thickness of barrier layer 14 is usually established in the range from about 0.1 to 5 μm, or more preferably, about 0.5 to 2 μm, so that it operates as a barrier layer for injection of carriers from the substrate to the photoconductive layer without causing a high residual potential and breakdown. The resistivity of barrier layer 14 is ordinarily about $10^6$ ohm-cm. As mentioned above, barrier layer 14 is formed of a-SiC:H,B. For an amorphous hydrogenated silicon carbide, an excellent film property may be obtained even if it is heavily doped with boron. Barrier layer 14, as is well-knoen, operates such that injection of carriers from substrate 12 into photoconductive layer 16 may be effectively inhibited, and transport of photocarriers generated in photoconductive layer 16 by irradiation with electromagnetic waves may be smoothly permited.

Photoconductive layer 16 operates such that sufficient photocarriers are generated in the layer in response to irradiation of electromagnetic waves. Therefore, it should be sensitive to electromagnetic waves extending over a wide range of wavelength. Especially, photoconductive layer 16 must have a high sensitivity to a long wavelength light, for example, about 700–800 nm, in order to apply to laser beam printers. The irradiated light must be almost absorbed in photoconductive layer 16 in order to generate photocarriers therein effectively. To meet these requirements, the thickness of photoconductive layer 16 must be more than 5 μm. However, it should be limited by carrier transport characteristics, i.e., it must be less than 70 μm. Preferably, the thickness of photoconductive layer 16 lies in the range from about 5 to 25 μm. Also, photoconductive layer 16 must have a sufficient photoconductivity, for example, more than $10^{-7}$ cm²/V, and a high dark resistivity, for example, more than $10^{11}$ ohm-cm. These requirements are satisfied by incorporating carbon atoms and doping with boron by taking appropriate measures. The content of carbon should be in the range from about 1 to 15 atomic %, more preferably, about 5 to 10 atomic %. Also, the content of boron should be in the range from about $1\times10^{-7}$ to $1\times10^{-3}$ atomic %, more preferably, about $1\times10^{-7}$ to $1\times10^{-4}$ atomic %. The impurity density, i.e., boron content must be controlled to be less than about 10% of the boron content of barrier layer 14. By this light doping, the mobility of holes is increased and the dark resistivity becomes high, for example, about $10^{11}$ ohm-cm to $10^{14}$ ohm-cm. As a result, charge acceptability and charge retentivity are greatly improved. Generally, this photoconductive layer 16 changes its resistivity under $10^7$ ohm-cm according to irradiation of electromagnetic waves, for example, light exposure having a wavelength of about 633 nm and an intensity of about $10^{15}$ photons/cm$^2$-sec. Photoconductive layer 16 formed of a-SiC:H,B is prevented from falling into a state called "fatigue". Generally, photoreceptors result in a high trapping state concentration after image forming cycles including corona charging and light exposure, so that the lowering of charge retentivity and the increase of residual charge potential are observed. This phenomenon is called fatigue. Photoconductive layer 16 is hardly ever fallen into fatigue because of its wide optical band gap of about 1.75 eV.

Covering layer 18 is formed of a-SiC:H,B and operates so as to achieve a stable charge acceptance and to prevent the surface of photoreceptor 10 from oxidizing by corona charging. For these functions, a high resistivity, a high chemical stability and a high light transmittance are required. This is satisfied by using a-SiC:H,B with a wide optical band gap of about 2.2 eV. Also, the optical band gap should be more than that of photoconductive layer 16. When compared with silicon nitride and silicon oxide, the optical band gap of a-SiC:H,B is rather narrower; however, the mobility of electrons may be increased by lightly doping with elements in Group IV-A or V-A of the Periodic Table. Therefore, the thickness of the layer does not affect photosensitivity and residual potential of the photoreceptor. The generated photocarriers in covering layer 18 may pass through within a short time even if it absorbs light, which is limited to a short wavelength light because of its wide optical band gap. Therefore, the film thickness may be thickened up to about 0.1–5 μm or so by using a-SiC:H,B. Accordingly, according to the present invention, this layer is chemically more stable, has a longer life and is higher in charge acceptance than insulators such as silicon nitride and silicon oxide. To meet the requirements of a wide optical band gap and a high resistivity, covering layer 18 contains carbon and is lightly doped with boron. The content of carbon lies in the range from about 15 to 25 atomic %, more preferably, about 20 to 25 atomic %. The impurity density should be in the range from about $1\times10^{-7}$ to $1\times10^{-4}$ atomic %. The preferable thickness of covering layer 18 lies in the range from about 0.5 to 1 μm. The thusly prepared covering layer has a high resistivity of $10^{13}$ ohm-cm or more, and a wide optical band gap of about 2.2 eV. The resistivity of covering layer 18 may not be decreased below about $10^{11}$ ohm-cm by light exposure.

Also, hydrogen atoms are incorporated into photoconductive layer 16 and covering layer 18 by decomposing silanes with glow discharge. The content of hydrogen in these layers will be in the range from about 10 to 20 atomic %.

Methods based on glow discharge, sputtering, ion plating, ion implantation, and the like can be used to prepare these layers of the present invention. For example, a multi-layered structure as described above is achieved using the glow discharge apparatus shown in FIG. 2.

Referring now to FIG. 2, there is illustrated a schematic diagram of a capacitively coupled glow discharge apparatus used for the fabrication of photoreceptor 10.

A glow discharge deposition chamber 20 contains substrate 12 fixed to a fixing member 22. In this example, substrate 12 is formed in the shape of a cylindrical drum made of aluminum. Chamber 20 is fixed to a base member 24. Fixing member 22 is fixed to a driving shaft 26 which is coupled to a motor 28 through base member 24. Also, inside substrate 12 is disposed a heater 30 for heating substrate 12. Substrate 12 is grounded through fixing member 22, driving shaft 26, base member 24 and chamber 20. Inside chamber 20, an electrode 32 having gas outlets 34 is disposed so as to surround substrate 12. This electrode 32 is insulated to chamber 20 and is formed as a pipe to introduce gas into chamber 20 through outlets 34. A gas conduit 36 is connected to electrode 32. Gas conduit 36 is connected to respective bombs 38, 40, 42 and 44 for containing reaction gases, for example, $SiH_4$, $B_2H_6$ diluted with He (2,000 ppm), $B_2H_6$ diluted with He (20 ppm) and $CH_4$ through respective mass flow controllers (MFC) 46, 48, 50 and 52. A power supply (RF) 54 is connected to cylindrical electrode 32 through a matching box (MB) 56 so as to apply a radio frequency power of 13.56 MHz between electrode 32 and a grounded terminal. When power supply 54 is operated, a radio frequency power is applied to cause glow discharge in chamber 20. Chamber 20 is also connected to an exhausting device including a mechanical booster pump (MBP) 58 and a rotary pump (RP) 60 through a valve 62. This valve 62 is controlled by an automatic pressure controller (APC) 64 in order to maintain a predetermined pressure for deposition.

Now, valve 62 is fully opened by APC 64, and MBP 58 and RP 60 are operated to produce a vacuum of about $10^{-3}$–$10^{-4}$ Torr. Substrate 12 is heated to about 100°–400° C. by heater 30 and rotated by motor 28 in order to unify the thickness and physical properties of deposited layers. Then, reactant gases containing silicon atoms such as $SiH_4$, $Si_2H_6$ and $SiF_4$, dopant gases including elements in Group III-A or V-A of the Periodic Table, for example, $B_2H_6$, $BF_3$, $PH_3$ and $PF_3$, and gases containing carbon atoms such as $CH_4$, $C_2H_6$ and $C_2H_2$ are mixed by MFC 46–52 and introduced into chamber 20 through cylindrical electrode 32 and conduit 36. In FIG. 2, $SiH_4$ comprises the reactant gas, $B_2H_6$ diluted with He (2,000 ppm) and $B_2H_6$ diluted with He (20 ppm) comprise dopant gases, and $CH_4$ is used as the gas containing carbon atoms, in bombs 38–44, respectively. The exhaust speed is controlled by APC 64 so that the reaction pressure reaches to about 0.1–10 Torr in chamber 20 and the pressure reaches a steady state. Then, RF 54 is operated to cause glow discharge in chamber 20, and $SiH_4$ and $CH_4$ are decomposed to deposit layers on substrate 12. Also, impurities are introduced into chamber 20 by controlling MFC 48 and 50. The deposition rate of layers depends on the applied radio frequency power, for example, a deposition rate of 12 μm/hour responding to a high power of about 200–400 W.

The present invention will be described further with reference to the following examples which should not be considered as limitations on the present invention.

EXAMPLE 1

In accordance with the procedure described below, a photoreceptor of the present invention was prepared by using the apparatus shown in FIG. 2.

An aluminum substrate 12 was provided in the form of a cylindrical drum, whereby it may be applied to xerographic copying machines. Substrate 12 was cleaned and fixed to fixing member 22. Then, substrate 12 was rotated by motor 28 and heated to about 250° C. by heater 30 while a high vacuum (about $10^{-3}$–$10^{-4}$ Torr) was achieved inside chamber 20 by MBP 58 and RP 60. Next, gases were introduced into chamber 20 so that the flow rate of $SiH_4$ was about 400 SCCM, the flow rate of $B_2H_6$ was about $1\times10^{-2}$–5% of that of $SiH_4$ and the flow rate of $CH_4$ was about 10–100% of that of $SiH_4$. These flow rates were controlled by MFC 46–52. Thus, the gaseous mixture of $SiH_4$, $B_2H_6$ (diluted with He) and $CH_4$ was introduced into chamber 20 and was blown against an outer periphery of substrate 12 rotated by motor 28. The reaction pressure was established at about 10 Torr by APC 64 and was maintained. Then, a radio frequency power of about 200 W was applied to electrode 32 by RF 54. Before the operation of RF 54, a matching operation for effectively transmitting the radio frequency power was provided. Thus, depositing was performed for 5 minutes. After that, barrier layer 14 having a thickness of about 1 μm was deposited on the surface of substrate 12. This layer was made of a-SiC:H,B. This layer prevents electrons in substrate 12 from being injected into the photoconductive layer.

Next, valve 62 was fully opened and the introduction of gaseous mixture was discontinued, whereby a high vacuum was established again. After purge of the gaseous mixture, gases were introduced into chamber 20 such that the flow rate of $SiH_4$ was about 400 SCCM, the flow rate of $B_2H_6$ was about $1\times10^{-6}$–$1\times10^{-3}$% of that of $SiH_4$, and the flow rate of $CH_4$ was about 10–100% of that of $SiH_4$. These flow rates were also controlled by MFC 46–52. The reaction pressure was maintained at 10 Torr by APC 64. Then, a radio frequency power of about 500 W was applied to electrode 32 by RF 54 for 2 hours. Thus, photoconductive layer 16 having a thickness of about 24 μm was deposited on the surface of barrier layer 14. This layer was formed of a-SiC:H,B.

By repeating the same procedure, covering layer 18 was deposited on the surface of photoconductive layer 16. In this fabrication stage, the flow rate of $SiH_4$ was established at 100 SCCM, the flow rate of $CH_4$ was increased to about 100–300% of that of $SiH_4$ and the depositing operation was performed for 20 minutes. Other conditions were the same as those for photoconductive layer 16. Thus, a thickness of about 1 μm was obtained. The resulting photoreceptor displayed excellent properties. The surface potential was improved up to 800 V when corona discharge was applied under the condition of a flow-in current of 0.4 microcoulomb/cm$^2$ from the corona charger to substrate 12. Further, charge acceptability was improved 20% or more when compared with a photoreceptor made of a-Si. Also, charge retentivity was greatly improved, for example, the charge retaining rate was about 80% at 15 seconds after corona discharge. Moreover, it had a high sensitivity, for example, the magnitude of exposure for the decay half life was 0.3 lux. second at an initial surface potential of 600 V. Further, breakdown voltage was improved up to 1500 V or more when compared with a conventional layer comprising a-Si in which breakdown occurred at 200 V. Also, it was confirmed that a clear image was formed even in the case of repetitive use for 2,000,000 copies without increasing of residual potential. Further, covering layer 18 had a sufficient thickness to refresh the surface by polishing.

The contents of constituent atoms were as shown in Table 1.

TABLE 1

| | Density | | |
|---|---|---|---|
| | Boron density | | Carbon density |
| Layers | B/(B + Si) | atomic % | C/(C + Si) atomic % |
| Covering Layer | $1\times10^{-7}$ | $1\times10^{-4}$ | 15–25 |
| Photoconductive Layer | $1\times10^{-7}$ | $1\times10^{-4}$ | 1–15 |
| Barrier Layer | $1\times10^{-3}$ | 2 | 1–15 |

As shown in Table 1, boron density was highest in barrier layer 14 and carbon density was highest in covering layer 18.

EXAMPLE 2

Figure 3:
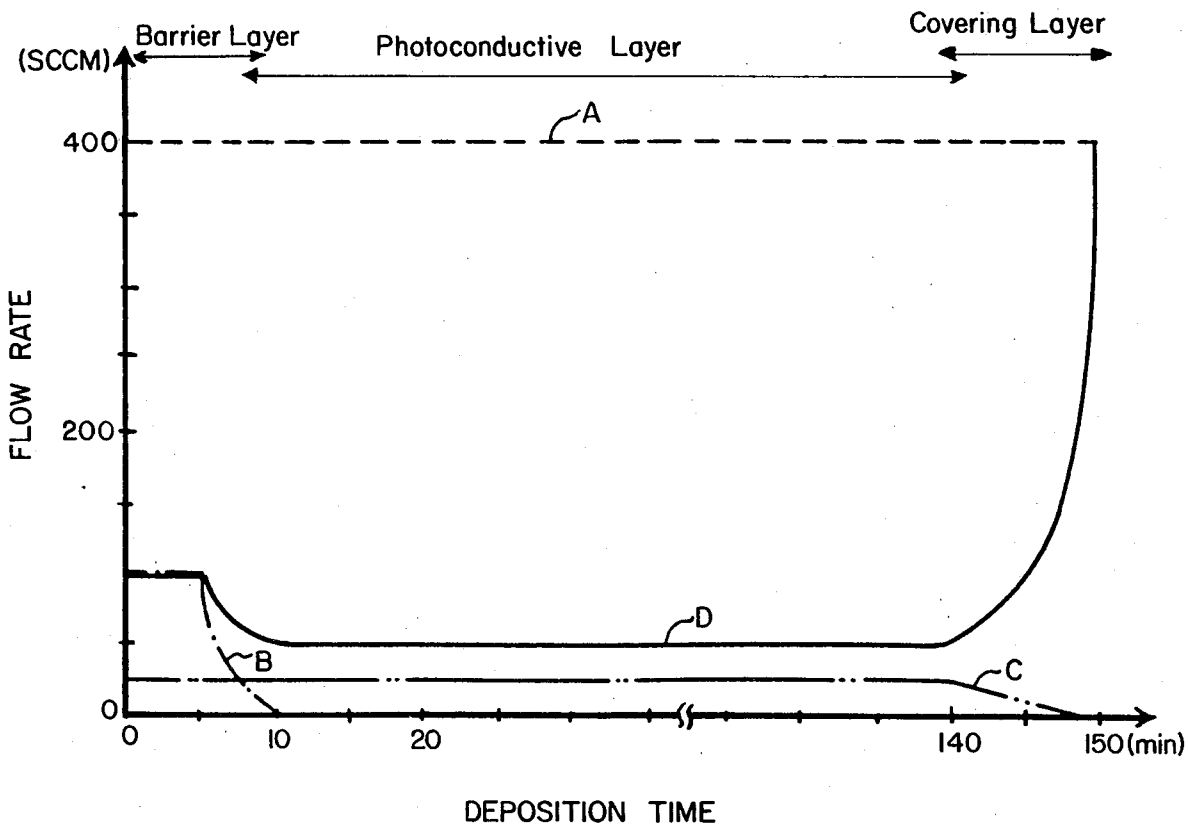
FIG. 3 is a graph showing a method for preparing the electrophotographic photosensitive member according to the present invention.

A photoreceptor was prepared in accordance with the procedure as described in the foregoing Example 1, except that gases were continuously introduced without purge. Namely, the flow rates of gases introduced into chamber 20 was controlled by MFC 46–52 as shown in FIG. 3 and Table 2. $SiH_4$ reactant gas contained in bomb 38 was introduced into chamber 20 with a constant flow rate of 400 SCCM for a deposition time period of 150 minutes. Dopant gas of $B_2H_6$ diluted with He (2,000 ppm) contained in bomb 40 was introduced into chamber 20 with a constant flow rate of 100 SCM for 5 minutes, and a decreasing flow rate of 100 $e^{-0.4(t-5)^2}$ SCCM (where t represents time) for the following 5 minutes. Dopant gas of $B_2H_6$ diluted with He (20 ppm) and contained in bomb 42 was introduced into chamber 20 with a constant flow rate of 25 SCCM for 140 minutes and a decreasing flow rate of 25 $e^{-0.1(t-140)^2}$ SCCM (where t represents time) for the following 10 minutes. Further, $CH_4$ gas contained in bomb 44 was introduced into chamber 20 with a constant flow rate of 100 SCCM for 5 minutes, a decreasing flow rate of 100 $e^{-0.03(t-5)^2}$ SCCM (where t represents time) for the following 5 minutes, a constant flow rate of 50 SCCM for the following 130 minutes and then an increasing flow rate of 400 $e^{0.12(150-t)^2}$ SCCM (where t represents time) for the following the 10 minutes. For all the deposition time period of 150 minutes, a radio frequency power was applied to electrode 32 with a constant power, for example, in the range of about 200–400 W. Further, the pressure inside chamber 20 was maintained at 10 Torr. Thus, the resulting photoreceptor comprised barrier layer 14, photoconductive layer 16 and covering layer 18. As shown in FIG. 3, the boron density and carbon density was continuously changed at the boundaries between barrier layer 14 and photoconductive layer 16, and between photoconductive layer 16 and the covering layer. The boundaries of each the layers were not definitely formed because the density of constituent elements was changed gradually. As a result, separation of layers due to difference of strain in the layers was not observed. Further, an excellent electrophotographic properties were obtained.

TABLE 2

| References in FIG. 3 | Deposition Time Gases | (minutes) | Flow Rates (SCCM) |
|---|---|---|---|
| A | $SiH_4$ | 0–150 | 400 |
| B | $B_2H_6$ diluted with He (2000 ppm) | 0–5 | 100 |
| | | 5–10 | 100 $e^{-0.4(t-5)^2}$ |
| | | 10–150 | 0 |
| C | $B_2H_6$ diluted with He (20 ppm) | 0–140 | 25 |
| | | 140–150 | 25 $e^{-0.1(t-140)^2}$ |
| D | $CH_4$ | 0–5 | 100 |
| | | 5–10 | 100 $e^{-0.03(t-5)^2}$ |

TABLE 2-continued

| References in FIG. 3 | Gases | Deposition Time (minutes) | Flow Rates (SCCM) |
|---|---|---|---|
| | | 10–140 | 50 |
| | | 140–150 | 400 $e^{0.12(150-t)^2}$ |

What is claimed is:

1. An electrophotographic photosensitive member comprising:

(a) an electroconductive substrate;

(b) a barrier layer, provided on said substrate and comprised of amorphous hydrogenated silicon carbide doped with an atom of Group III-A or V-A in the Periodic Table as an impurity, for blocking injection of carriers from said substrate;

(c) a photoconductive layer, provided on said barrier layer and comprised of amorphous hydrogenated silicon carbide doped with an atom of Group III-A or V-A in the Periodic Table as an impurity, for generating photocarriers by light exposure; and (d) a covering layer, provided on said photoconductive layer and comprised of amorphous hydrogenated silicon carbide doped with an atom of Group III-A or V-A in the Periodic Table as an impurity, for retaining charges which may be neutralized by photocarriers generated in said photoconductive layers thereon.

2. An electrophotographic photosensitive member as claimed in claim 1, wherein the thickness of said barrier layer lies in the range from about 0.1 to 5 μm, the thickness of said photoconductive layer lies in the range from about 5 to 70 μm and the thickness of said covering layer lies in the range from about 0.1 to 5 μm.

3. An electrophotographic photosensitive member as claimed in claim 1, wherein the impurity contained in all said barrier, photoconductive and covering layers comprises boron or phosphorus.

4. An electrophotographic photosensitive member as claimed in claim 1, wherein the impurity density of said barrier layer is higher than that of said photoconductive layer or said covering layer.

5. An electrophotographic photosensitive member as claimed in claim 1, wherein said covering layer has a resistivity of at least about $10^{13}$ ohm-cm.

6. An electrophotographic photosensitive member as claimed in claim 1, wherein said photoconductive layer has a resistivity of at least about $10^{11}$ ohm-cm.

7. An electrophotographic photosensitive member as claimed in claim 1, wherein said covering layer has an optical energy gap greater than that of said photoconductive layer.

8. An electrophotographic photosensitive member comprising:

(a) a substrate;

(b) a barrier layer, provided on said substrate, for blocking injection of carriers from said substrate, said barrier layer comprising an amorphous material which is comprised of silicon and carbon and which is doped with an atom of Group III-A or V-A in the Periodic Table as an impurity present in the range from about $5\times10^{-3}$ to 1 atomic %;

(c) a photoconductive layer, provided on said barrier layer, for generating photocarriers by light exposure, said barrier layer comprising an amorphous material which is comprised of silicon and carbon, which is doped with an atom of Group III-A or V-A in the Periodic Table as an impurity, which has a photoconductivity of more than $10^{-7}$ cm$^2$/V, and which has a dark resistivity of more than $10^{11}$ ohm-cm; and (d) a covering layer, provided on said photoconductive layer, for retaining charges which can be neutralized by photocarriers generated in said photoconductive layer, said covering layer comprising an amorphous material which is comprised of silicon and carbon, which is doped with an atom of Group III-A or V-A in the Periodic Table as an impurity, and which has an optical band gap this is larger than that of said photoconductive layer.

9. An electrophotographic photosensitive member as claimed in claim 8, wherein said barrier layer has a higher impurity density than does said photoconductive layer.

10. An electrophotographic photosensitive member as claimed in claim 8, wherein said photoconductive layer has an impurity density that changes gradually at the boundary of said photoconductive layer with said barrier layer and said covering layer, respectively.

11. An electrophotographic photosensitive member as claimed in claim 10, wherein said photoconductive layer has a carbon density that changes gradually at the boundary of said photoconductive layer with said barrier layer and said covering layer, respectively.

12. An electrophotographic photosensitive member as claimed in claim 8, wherein (a) said barrier layer has a carbon density in the range from about 1 to 15 atomic %, (b) said photoconductive layer has a carbon density in the range from about 1 to 15 atomic % and (c) said covering layer has a carbon density in the range from about 15 to 25 atomic %.

* * * * *